US010156332B2

(12) United States Patent
Marley et al.

(10) Patent No.: US 10,156,332 B2
(45) Date of Patent: Dec. 18, 2018

(54) MODULAR HEADLAMP ASSEMBLY HAVING A LOW BEAM MODULE

(71) Applicant: Truck-Lite Co., LLC, Falconer, NY (US)

(72) Inventors: Michael Marley, Erie, PA (US); Gregory Alan Stoi, Royal Oak, MI (US)

(73) Assignee: Truck-lite Co, LLC, Falconer, NY (US)

( * ) Notice: Subject to any disclaimer, the term of this patent is extended or adjusted under 35 U.S.C. 154(b) by 0 days.

(21) Appl. No.: 15/375,352

(22) Filed: Dec. 12, 2016

(65) Prior Publication Data

US 2017/0089534 A1 Mar. 30, 2017

Related U.S. Application Data

(62) Division of application No. 13/246,481, filed on Sep. 27, 2011, now Pat. No. 9,518,711.

(51) Int. Cl.

| | |
|---|---|
| ***F21S 41/32*** | (2018.01) |
| ***F21S 41/19*** | (2018.01) |
| ***F21S 41/33*** | (2018.01) |
| ***F21S 45/49*** | (2018.01) |
| ***F21S 41/147*** | (2018.01) |
| ***F21S 45/47*** | (2018.01) |
| ***F21S 41/39*** | (2018.01) |
| ***F21S 41/43*** | (2018.01) |

(52) U.S. Cl.

CPC ..... *F21S 41/19* (2018.01); *F21S 41/147* (2018.01); *F21S 41/336* (2018.01); *F21S 41/39* (2018.01); *F21S 41/43* (2018.01); *F21S 45/47* (2018.01); *F21S 45/49* (2018.01)

(58) Field of Classification Search

CPC ... F21V 29/70; F21S 48/1159; F21S 48/1388; F21S 48/328

USPC ..... 362/538

See application file for complete search history.

(56) References Cited

U.S. PATENT DOCUMENTS

2002/0004251 A1* 1/2002 Roberts ..... H01L 23/49562 438/26

2010/0194276 A1* 8/2010 Okubo ..... F21S 48/1159 315/82

* cited by examiner

*Primary Examiner* — Christopher Raabe

(74) *Attorney, Agent, or Firm* — The Bilicki Law Firm, PC

(57) ABSTRACT

A modular headlamp assembly includes a low beam headlamp module, a high beam headlamp module, and front turn/parking lamp module. The low beam headlamp module and the high beam headlamp module are supported by a reflector carrier. Each of the high and low beam headlamp modules includes a heat sink and mounting assembly with a heat sink portion bisecting a reflector member. The reflector carrier is adjustably fastened to a housing to allow for adjustment of the high and low beam headlamp modules within the modular headlamp assembly.

8 Claims, 19 Drawing Sheets

MODULAR HEADLAMP ASSEMBLY HAVING A LOW BEAM MODULE

SUMMARY

A low beam headlamp module for a headlamp assembly includes a high beam headlamp module and a low beam headlamp module supported by a reflector carrier having a first receiving pocket for containing the low beam headlamp module and a second receiving pocket for containing the high beam headlamp module. The low beam headlamp module includes a low beam heat sink and mounting assembly having a low beam heat sink portion with first and second sides and a low beam mounting portion having alignment features formed therein. At least one first low beam LED light source is supported by the first side of the low beam heat sink portion and at least one second low beam LED light source is supported by the second side of the low beam heat sink portion. A low beam reflector member is attached to the low beam heat sink and mounting assembly such that the low beam heat sink portion separates the low beam reflector member into first and second reflector segments. Further, light emitted by the at least one first low beam LED light source is reflected by the first reflector segment and the light emitted by the at least one second low beam LED light source is reflected by the second reflector segment. The low beam headlamp module is positioned adjacent to the high beam headlamp module in the reflector carrier.

DETAILED DESCRIPTION

Figure 1:
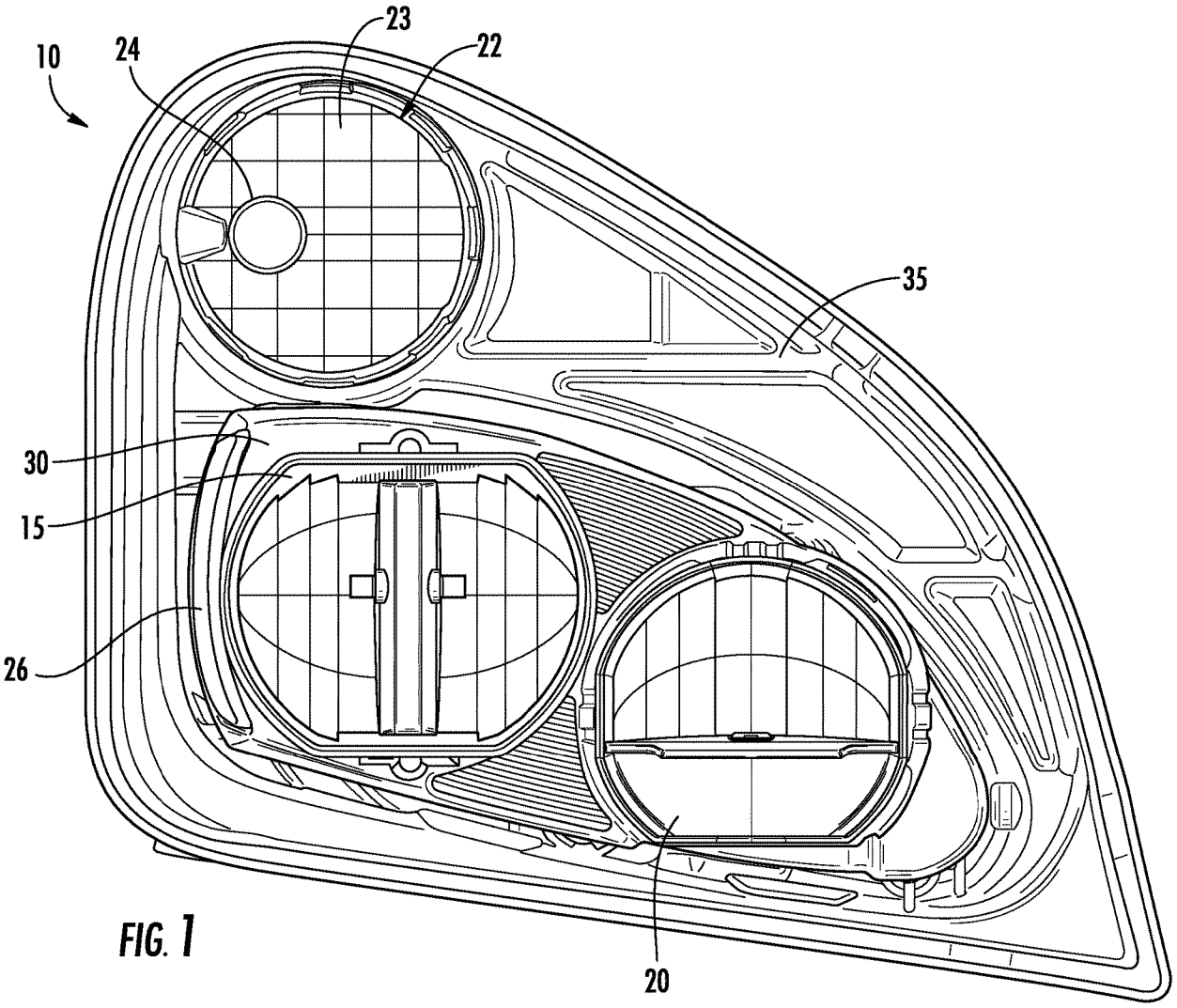
FIG. 1 is a front view of a modular headlamp assembly according to the present application.

As illustrated in FIG. 1, a modular headlamp assembly is generally indicated at 10. Modular headlamp assembly 10 includes a low beam headlamp module 15 and a high beam headlamp module 20. A front turn/parking lamp module 22 having a reflector 23 and a bulb 24 is also included. Low beam headlamp module 15 and high beam headlamp module 20 and a side reflex reflector 26 are supported by a reflector carrier 30, which is adjustably fastened to a housing 35. A lens (not shown) is provided over housing 35 for light to pass through from low beam headlamp module 15, high beam headlamp module 20, and front turn/parking lamp module 22. Each component of modular headlamp assembly will now be described in detail.

Figure 2:
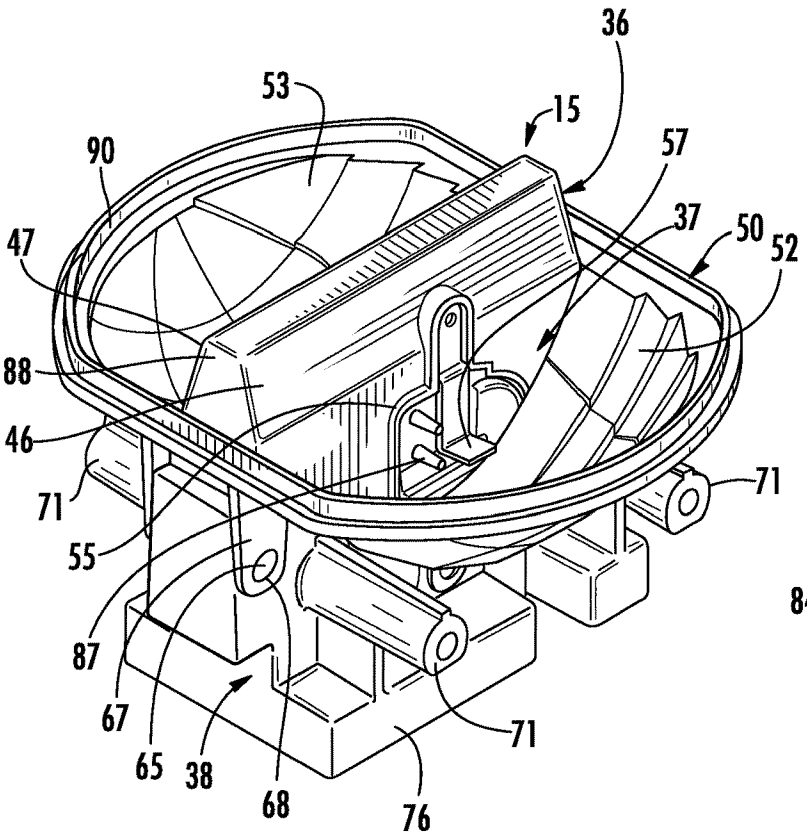
FIG. 2 is a perspective view of a low beam headlamp module of the modular headlamp assembly.

FIG. 2 is a perspective view of low beam headlamp module 15 of modular headlamp assembly 10 including a heat sink and mounting assembly 36, which has a low beam heat sink portion 37 and a low beam mounting portion 38. Heat sink and mounting assembly 36 is formed from a thermally conductive material such as die cast aluminum, copper or magnesium. In addition, the heat sink and mounting assembly 36 is treated with a black thermally emissive coating to facilitate heat transfer through radiation. The coating may be an E-coat, an anodized coating, or a powder coat. In the embodiment shown, low beam heat sink portion 37 is oriented and bisects low beam headlamp module vertically in order to aid in thermal transfer. However, in other embodiments low beam heat sink portion 37 may be oriented horizontally such that it bisects low beam headlamp module 15 horizontally.

In general, low beam headlamp module 15 includes at least one low beam LED light source 40, which may be a 1×2 or a 1×4 Altilon LED Assembly manufactured by Philips Lumileds. Low beam LED light source 40 is mounted to low beam heat sink portion 37, having first and second sides 46 and 47, that extends through a low beam reflector member 50 such that low beam heat sink portion 37 bisects reflector member 50 into first and second segments 52 and 53. In the embodiment shown low beam LED light source 40 is oriented such that the axis of the light emitting die on the light source is arranged substantially parallel with the axis of emitted light. Alternatively, the axis of the light emitting die on low beam LED light source 40 may be oriented substantially perpendicular to the axis of the emitted light. At least one of first and second sides 46 and 47 of low beam heat sink portion 37 includes a light source receiving portion 55 for containing low beam LED light source 40 and a light shield 57 positioned adjacent to low beam LED light source 40 for blocking a portion of the light in a low beam pattern. In particular, in the embodiment illustrated, light shield 57 blocks light from low beam LED light source 40 in the range of 10U-90U. With the illustrated light shield 57, the light intensity in the light pattern from 10 degrees UP to 90 degrees UP and 90 degrees LEFT to 90 degrees RIGHT will not exceed 125 candela. The shape and location of light shield 57 may vary according to the shape and design of modular headlamp assembly 10. There are several factors which dictate the location and shape of the part, such as orientation of the LED die, reflector shape, and position within reflector. A thermally conductive compound is disposed between low beam heat sink portion 37 and low beam LED light source 40. Low beam mounting portion 38 includes alignment features 65 formed on stepped portions 66 that extend from mounting structure for facilitating the alignment of low beam reflector member 50 with low beam mounting portion 38. In particular, low beam reflector member 50 includes tabs 67 with apertures 68 formed therein for mating with alignment features 65 of low beam mounting portion 38.

Figure 3:
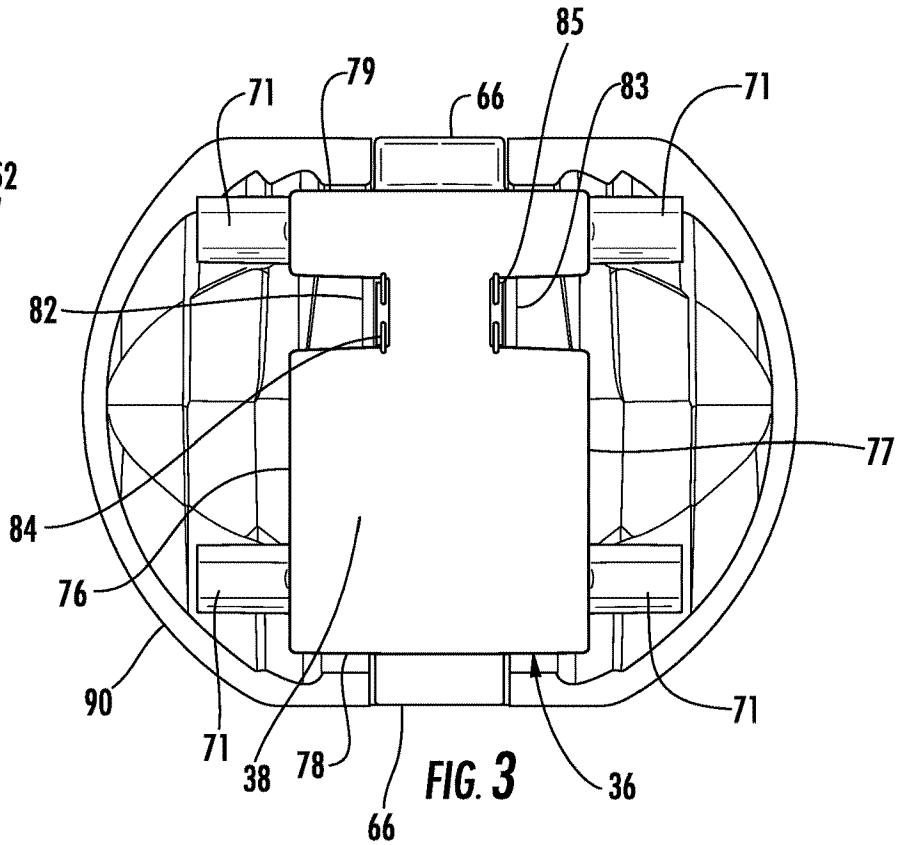
FIG. 3 illustrates bottom view of the low headlamp beam module.

FIG. 3 illustrates bottom view of low beam module 15. Low beam mounting portion 38 includes a base portion 70 which may be adapted to receive a driver circuit assembly (not shown). A plurality of mounting extensions 71 protrude from side edges 76 and 77 of base portion 70 adjacent to edges 78 and 79. In addition, channels 82 and 83 are formed within base portion 70 along edges 76 and 77 to accommodate electrical leads 84 and 85 from low beam LED light source 40.

Figure 4:
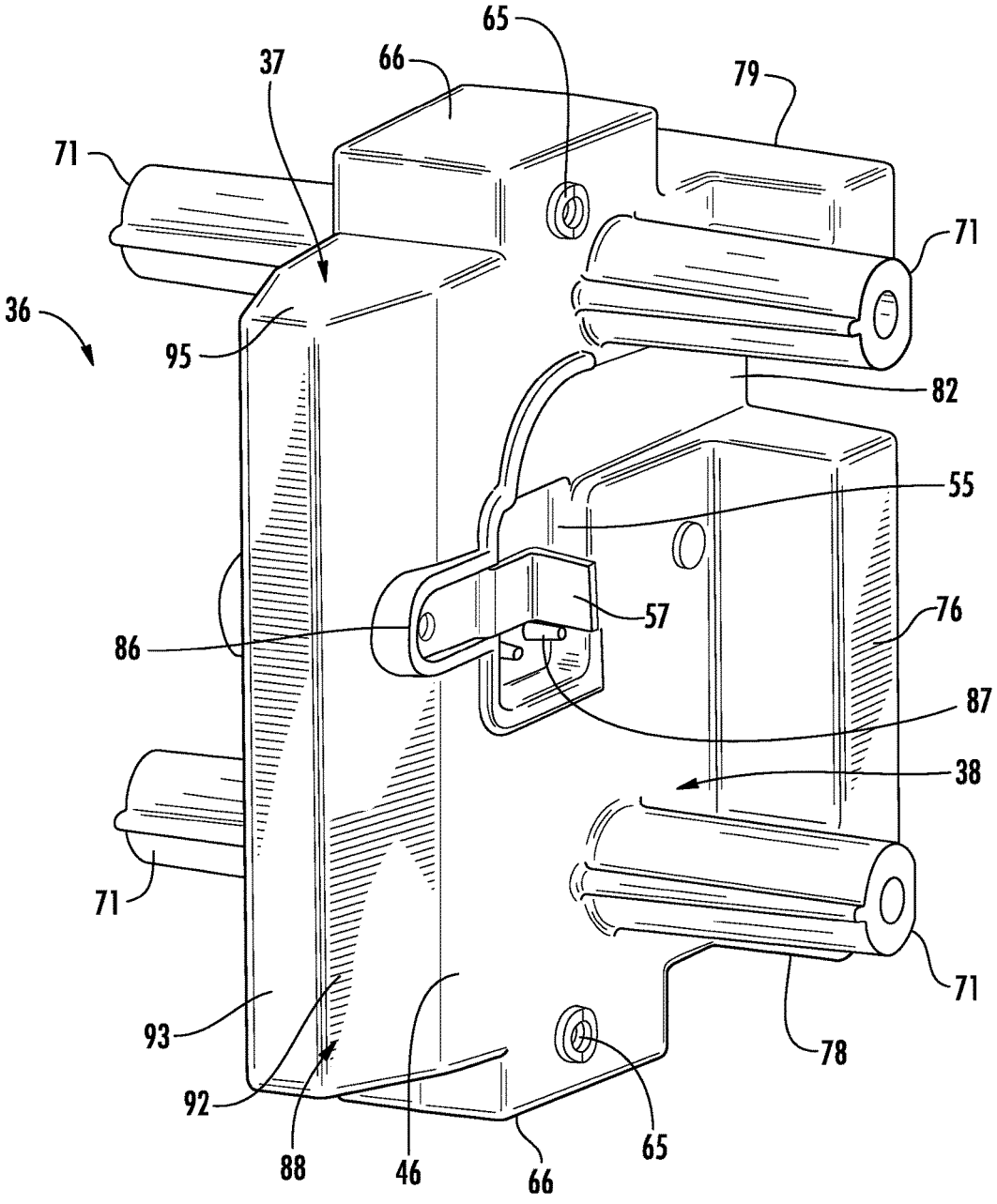
FIG. 4 illustrates a front perspective view of a low beam heat sink and mounting assembly.

FIG. 4 illustrates a front perspective view of heat sink and mounting assembly 36. As discussed above heat sink and mounting assembly 36 includes integrally formed low beam heat sink portion 37 and low beam mounting portion 38. With reference to FIGS. 2-4, low beam heat sink portion 37 includes first and second sides 46 and 47, each of which includes a light source receiving portion 55 with an upper arch 86 for facilitating the attachment of light shield 57. Light source receiving portion 55 may take the form of an indented area sized to receive an LED light source. Alignment posts, 87, may be formed in light source receiving portion 55 for aligning with datum features in an LED light source to insure that the LED light source is accurately located on heat sink portion 37. In addition, light source receiving portion 55 may include holes (not shown) formed therein for accepting fasteners, used for securing the LED light source to heat sink portion 37. An outwardly extending portion 88 of low beam heat sink portion 37 protrudes beyond a rim 90 of reflector 50, as shown in FIG. 2. Outwardly extending portion 88 includes first and second slanted sides, one of which is indicated at 92, a top edge 93 and first and second ends 95. Stepped portions 66 of low beam mounting portion 38 are positioned adjacent to and extend laterally compared to ends 95 of outwardly extending portion 88 of low beam heat sink portion 37 such that, in an assembled configuration, stepped portions 66 of low beam mounting portion 38 are disposed behind reflector member 50. Thus, it is the stepped portions 66 of low beam mounting portion 38 that facilitates the alignment of low beam reflector member 50 with low beam mounting portion 38. In particular, low beam reflector member 50 includes tabs 67 with apertures 68 formed therein for mating with alignment features 65 formed on stepped portions 66 of low beam mounting portion 38.

Figure 6:
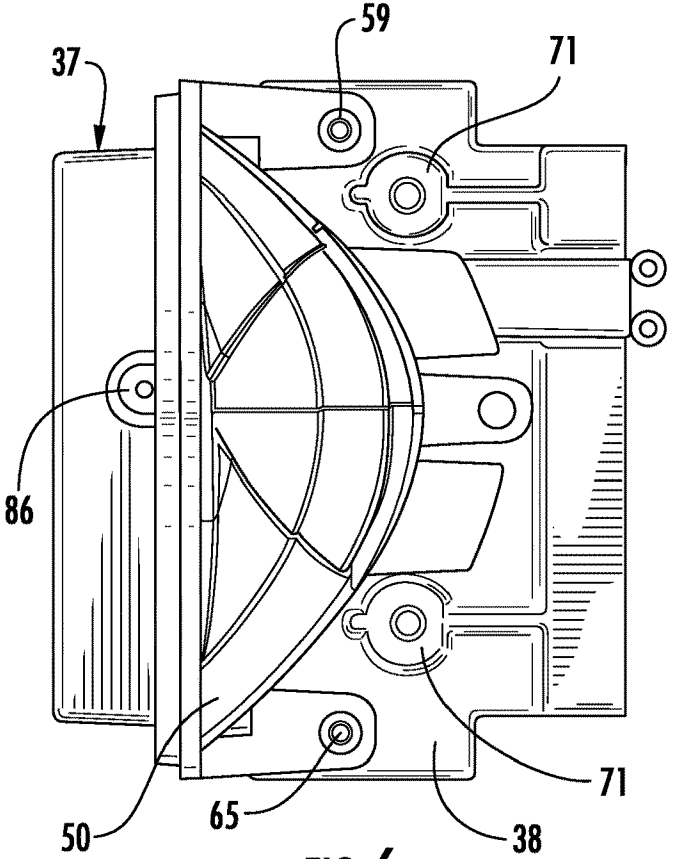
FIG. 6 is a side view of the low beam headlamp module.
Figure 5:
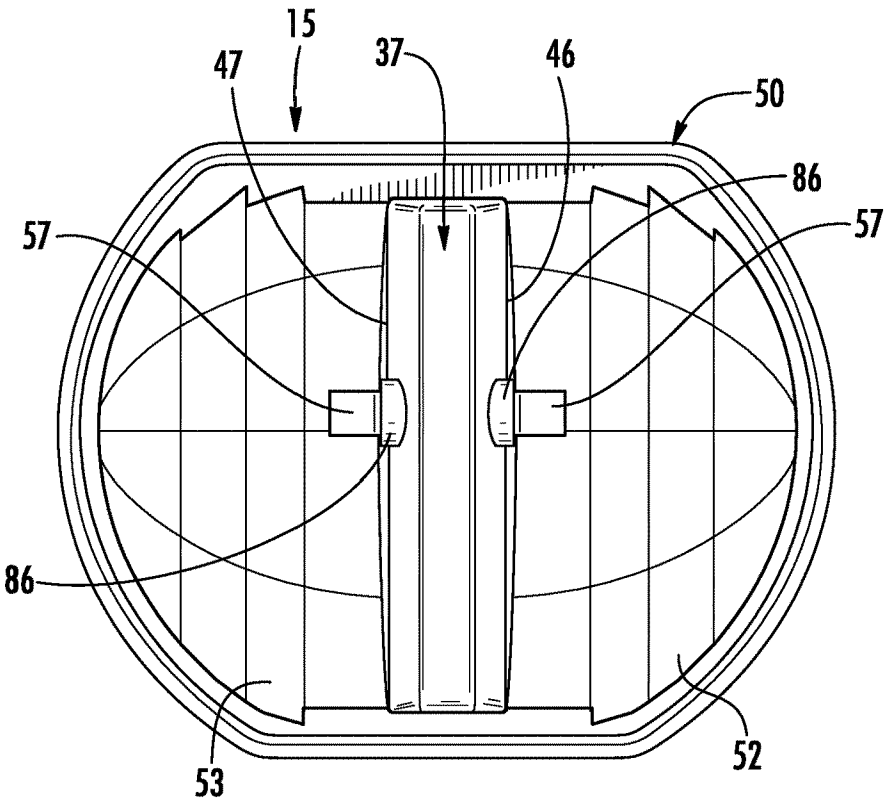
FIG. 5 is a front view of the low beam headlamp module.
Figure 8:
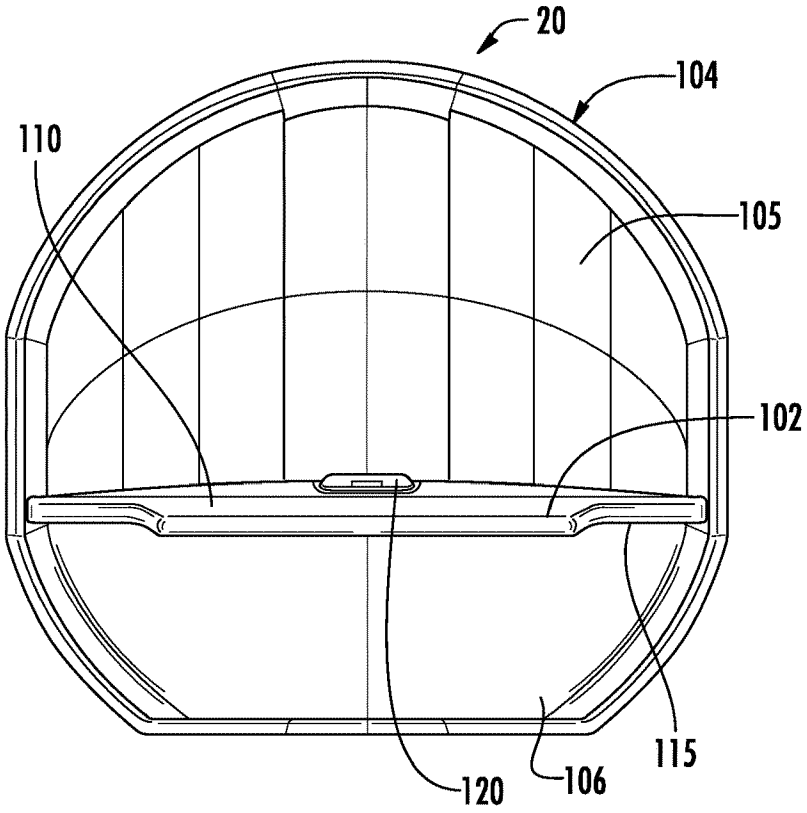
FIG. 8 is a front view of the high beam headlamp module.

FIG. 5 is a front view of low beam headlamp module 15 and FIG. 6 is a side view of low beam headlamp module 15. In particular, FIG. 5 illustrates reflector member 50 bisected into first and second segments 52 and 53 by low beam heat sink portion 37. Each of first and second sides 46 and 47 of heat sink portion 37 is shown with an upper arch 86 of light source receiving portion 55 and light shield 57. Light shield is a steel component; however, a thermoplastic material, such as glass filled nylon, could also be used. Alternatively, light shield 57 may be mounted to a BUSS bar rather than directly to low beam heat sink portion 37. Reflector member 50, in the embodiment shown, is a single component with reflective portions on both sides of low beam heat sink portion 37. Alternatively, reflector member 50 may be composed of multiple separate and distinct reflector components individually mounted on either side of low beam heat sink portion 37. Reflector member 50 is formed of a thermoplastic or thermoset vacuum metalized material. For example, reflector member 50 may be formed of ULTEM, polycarbonate, or a bulk molding compound. First and second segments 52 and 53 of reflector member 50 have a complex reflector optic design. The complex reflector optical design includes multiple intersecting segments. The segments intersect at points that may be profound and visible or blended to form a uniform single surface.

Figure 7:
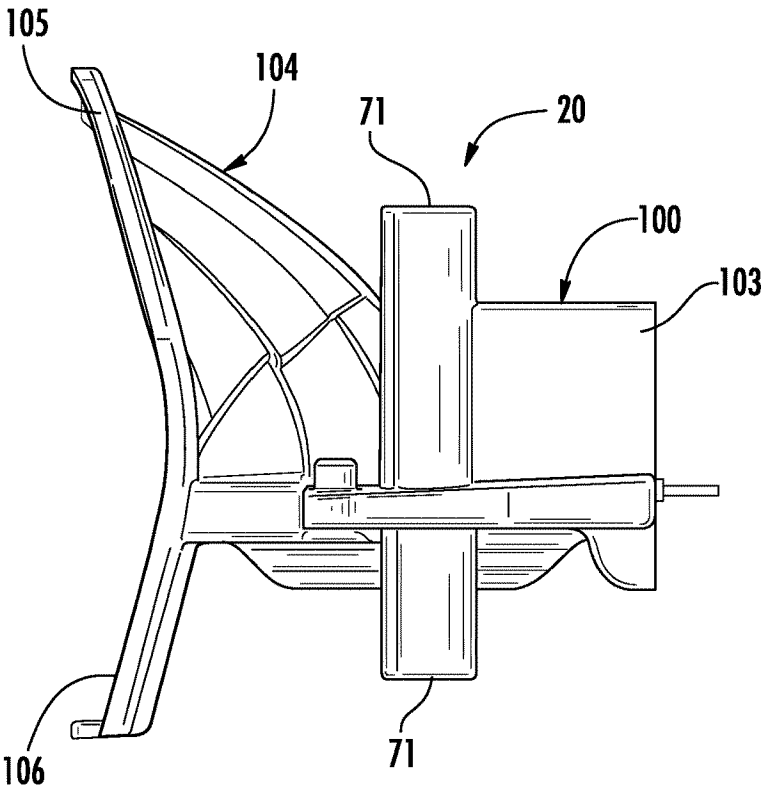
FIG. 7 is a side view of a high beam headlamp module of the modular headlamp assembly.

FIGS. 7-13 illustrate various views of high beam headlamp module 20. As shown in FIG. 7, high beam headlamp module 20 includes a high beam heat sink and mounting assembly 100 having a high beam heat sink portion 102 and a high beam mounting portion 103. Heat sink and mounting assembly 100 is formed from a thermally conductive material such as die cast aluminum, copper or magnesium. In addition, the heat sink and mounting assembly 100 is treated with a black thermally emissive coating to facilitate heat transfer through radiation. The coating may be an E-coat, an anodized coating, or a powder coat. A high beam reflector member 104 mounted to high beam heat sink and mounting assembly 100 such that high beam heat sink portion 102 extends outward towards a bottom end of reflector member 104.

Reflector member 104 includes an upper reflective portion 105 and a lower portion 106, which are separated by high beam heat sink portion 102. Upper reflective portion 105 has a complex reflector optic design. The complex reflector optical design includes multiple intersecting segments. The segments intersect at points that may be profound and visible or blended to form a uniform single surface. Reflector member 104, in the embodiment shown, is a single component surrounding high beam heat sink portion 102. Alternatively, reflector member 104 may be composed of multiple separate and distinct reflector components individually mounted on either side of high beam heat sink portion 102. Reflector member 104 is formed of a thermoplastic or thermoset vacuum metalized material. For example, reflector member 104 may be formed of ULTEM, polycarbonate, or a bulk molding compound.

High beam heat sink portion 102 includes first and second sides 110 and 115. A high beam LED light source 120 is mounted to first side 110 of high beam heat sink portion 102 in a light source receiving portion 122 formed therein. Light source receiving portion 122 may take the form of an indented area sized to receive High beam LED light source 120. Alignment posts, 123, may be formed in light source receiving portion 122 for aligning with apertures 124 in High beam LED light source 120 to insure that High beam LED light source 120 is accurately located on heat sink portion 102. In addition, light source receiving portion 122 may include holes (not shown) formed therein for accepting fasteners, used for securing the LED light source to heat sink portion 102. A thermally conductive compound may be disposed between high beam heat sink portion 102 and High beam LED light source 120.

Figure 9:
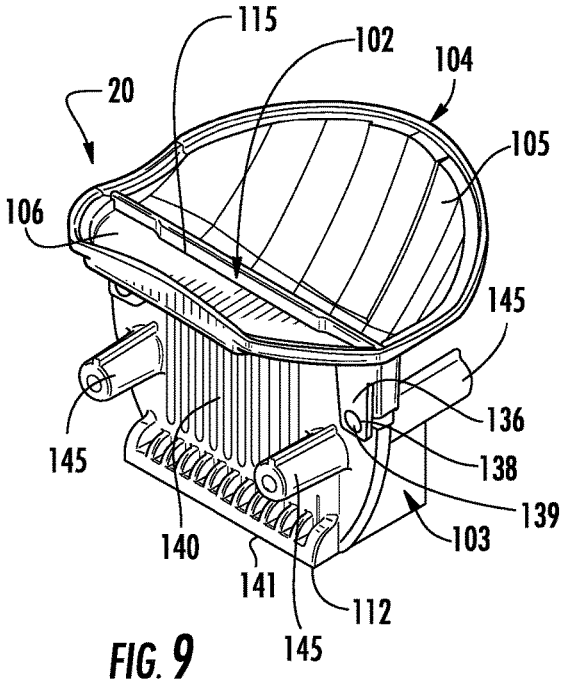
FIG. 9 is a perspective view of the high beam headlamp module.
Figure 10:
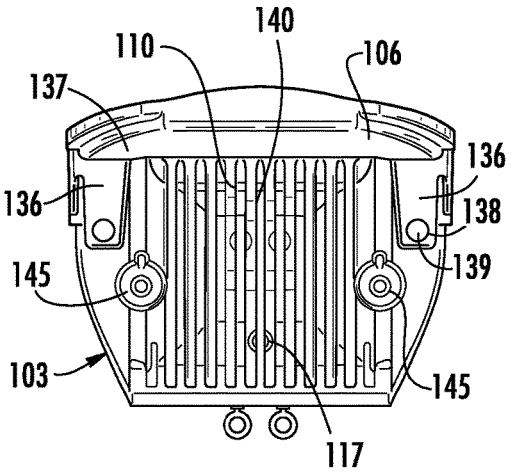
FIG. 10 is a bottom view of the high beam headlamp module.
Figure 11:
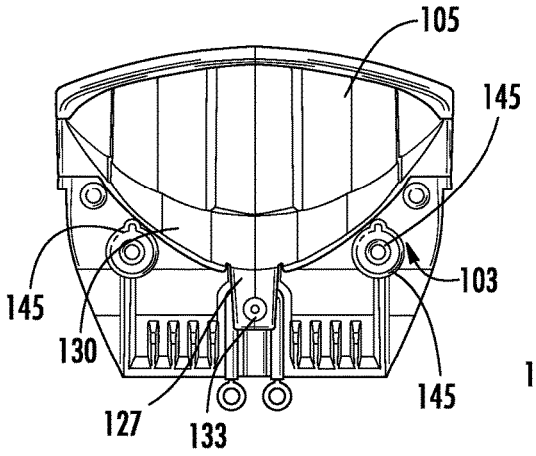
FIG. 11 is a top view of the high beam headlamp module.
Figure 12:
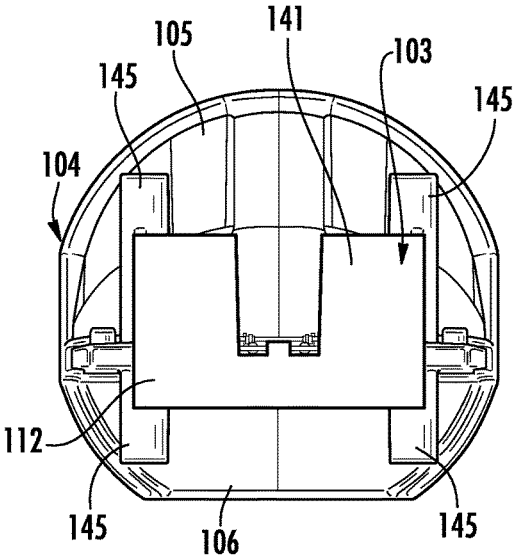
FIG. 12 is a back view of the high beam headlamp module.
Figure 13:
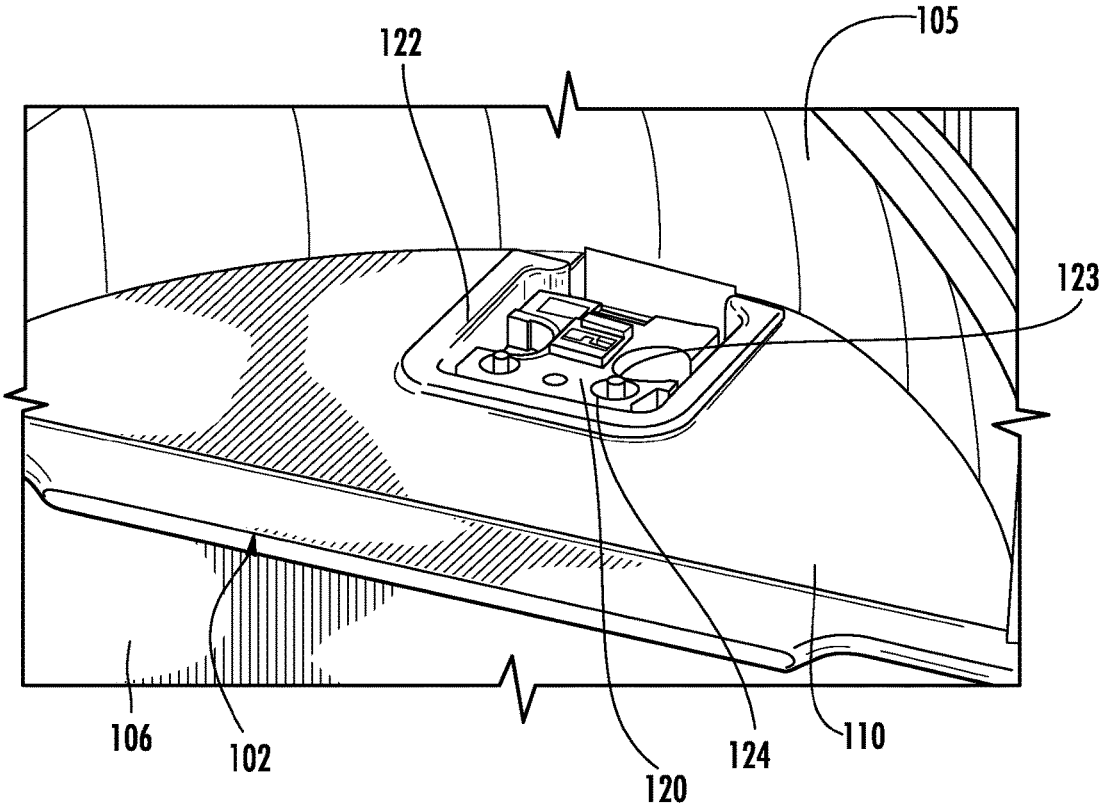
FIG. 13 is an enlarged view of a heat sink portion of the high beam headlamp module.

In the embodiment shown lower portion 106 is formed integrally with upper reflective portion 105 such that it extends below high beam heat sink portion 102, as shown in FIG. 7. In addition high beam reflector member 104 includes a tab 127 extending from a back end 130 of upper reflective portion 105. Tab 127 includes an aperture 133 formed therein for mating with an alignment feature 135 formed on high beam mounting portion 103 (see FIG. 11). Further, tabs 136 extend from a back end 137 of lower portion 106. Each of tabs 136 includes an aperture 138 formed therein for mating with alignment features 139 formed on high beam mounting portion 103, as shown in FIGS. 9 and 10. High beam mounting portion 103 includes fins 140 for heat dissipation which terminate at a base portion 141. A plurality of mounting extensions, one of which is indicated at 145, protrude from high beam mounting portion 103 for mounting high beam headlamp module 20 to reflector carrier 30.

Figure 14:
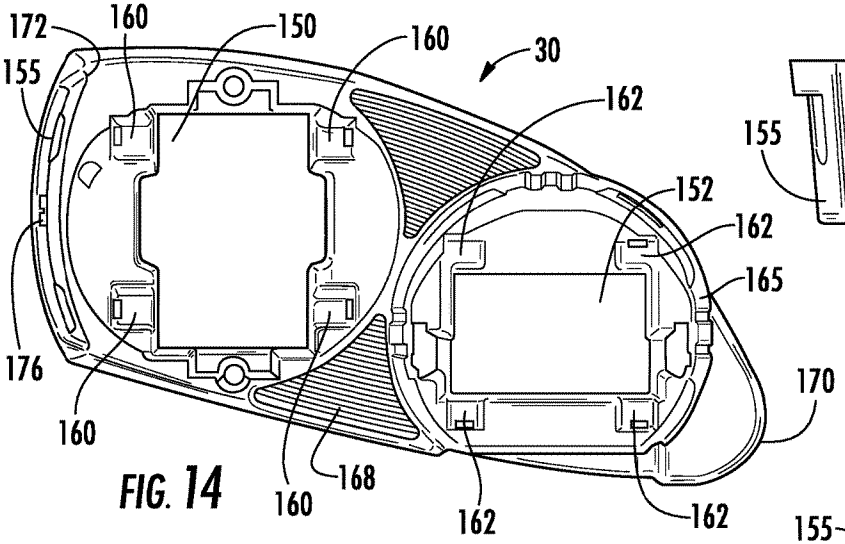
FIG. 14 is a front view of a reflector carrier of the modular headlamp assembly.

FIG. 14 is a front view of reflector carrier 30 of modular headlamp assembly 10. Reflector carrier 30 includes a first receiving pocket 150 for low beam headlamp module 15 and a second receiving pocket 152 for high beam headlamp module 20. Additionally, reflector carrier 30 includes a receiving slot 155 for a side reflex reflector 26 (see FIG. 18). Molded within first receiving pocket 150 are recesses 160 for accepting mounting extensions 71 of low beam module 15 such that low beam module 15 is properly aligned within reflector carrier 30. Similarly, second receiving pocket 152 includes recesses 162 formed therein for accepting mounting extensions 145 of high beam module 20 such that high beam module 20 is properly aligned within reflector carrier.

Figure 15:
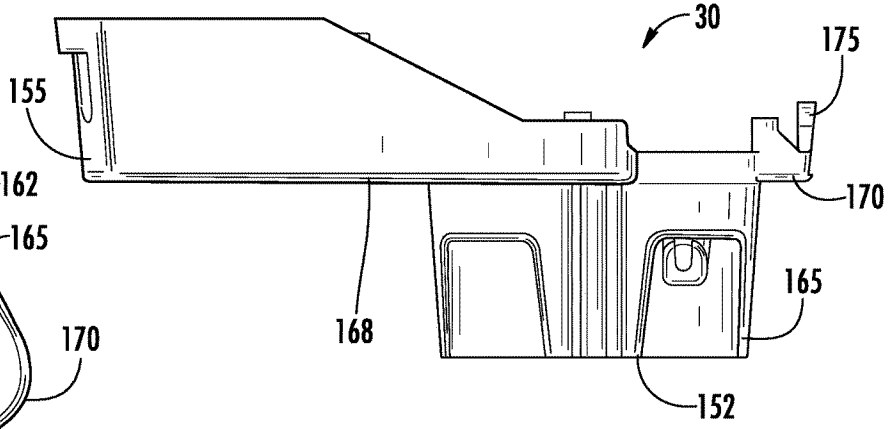
FIG. 15 is a top view of the reflector carrier of the modular headlamp assembly.
Figure 16:
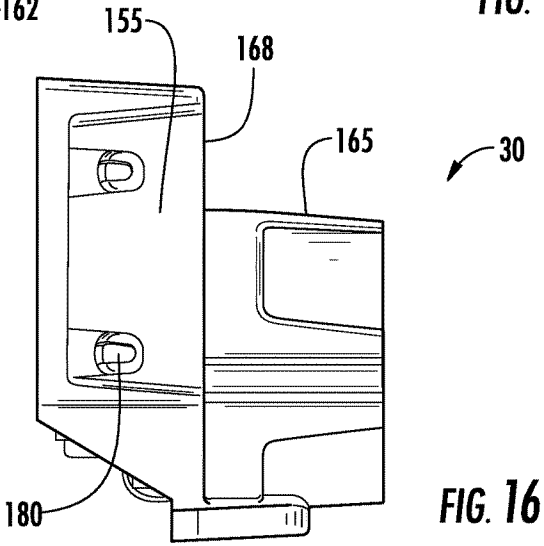
FIG. 16 is a side view of the reflector carrier of the modular headlamp assembly.
Figure 17:
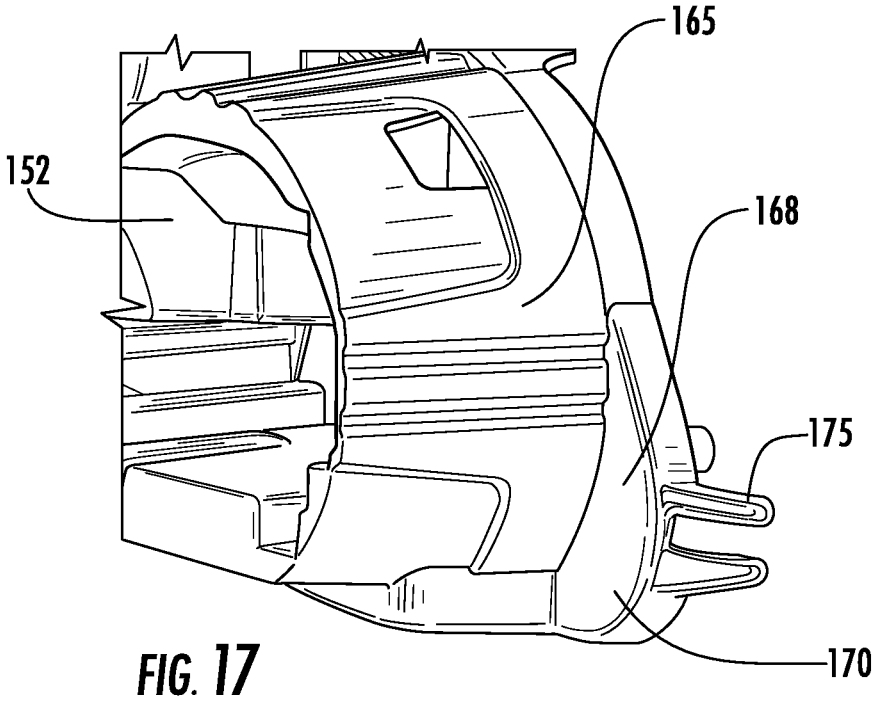
FIG. 17 is a side cut away view of a stabilizer feature of reflector carrier.

As shown in FIGS. 15 and 16, which are top and side views of reflector carrier 30, second receiving pocket 152 for high beam module 20 includes side wall 165 that extends forwardly with respect to a base 168 and is shaped to accommodate high beam module 20. Base 168 extends between first and second receiving pockets 150 and 152 as well as on opposite ends of first and second receiving pockets 150 and 152. In particular, base 168 extends to a lower corner 170 adjacent to second receiving pocket 152 and to an upper corner 172 adjacent to first receiving pocket 150. As shown in FIGS. 15 and 17, a carrier stabilizer feature 175, which may be a two pronged connector, extends from lower corner 170 to facilitate the attachment of reflector carrier 30 to housing 35.

Figure 18:
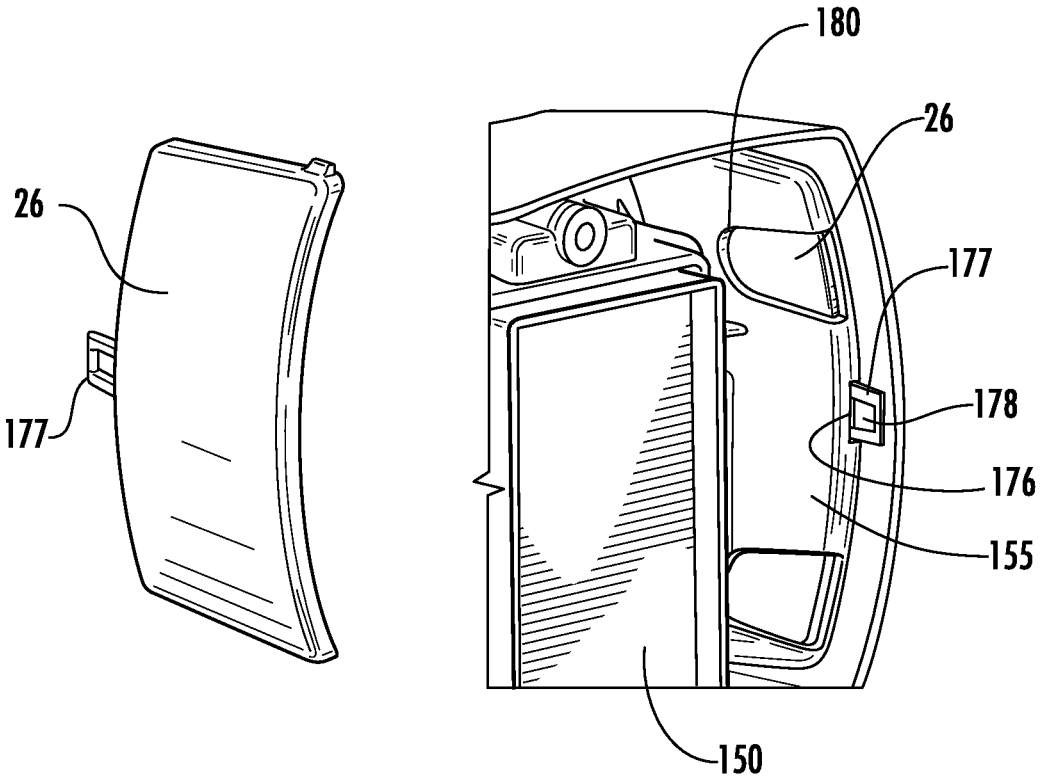
FIG. 18 is a back cut away view of a receiving slot for a side reflex reflector.

With reference to FIGS. 16 and 18, receiving slot 155 for side reflex reflector 26 is molded within reflector carrier 30 adjacent to first receiving pocket 150 and upper corner 172. Receiving slot 155 includes a slit 176 for accommodating a snap feature 177 formed on side reflex reflector 26. A notch 178 is formed on an inner wall of reflector carrier 30 adjacent to slit 176 for mating with snap feature 177 in order to secure the position of side reflex reflector 26. In the embodiment shown, when side reflex reflector 26 is installed, snap feature 177, which may be a U-shaped extension, passes through slit 176 of reflector carrier 30 and engages notch 178 to prevent further movement of side reflex reflector 26. Openings 180 may also be formed within receiving slot to assist in installing and aligning side reflex reflector 26 within receiving slot 155.

Figure 19:
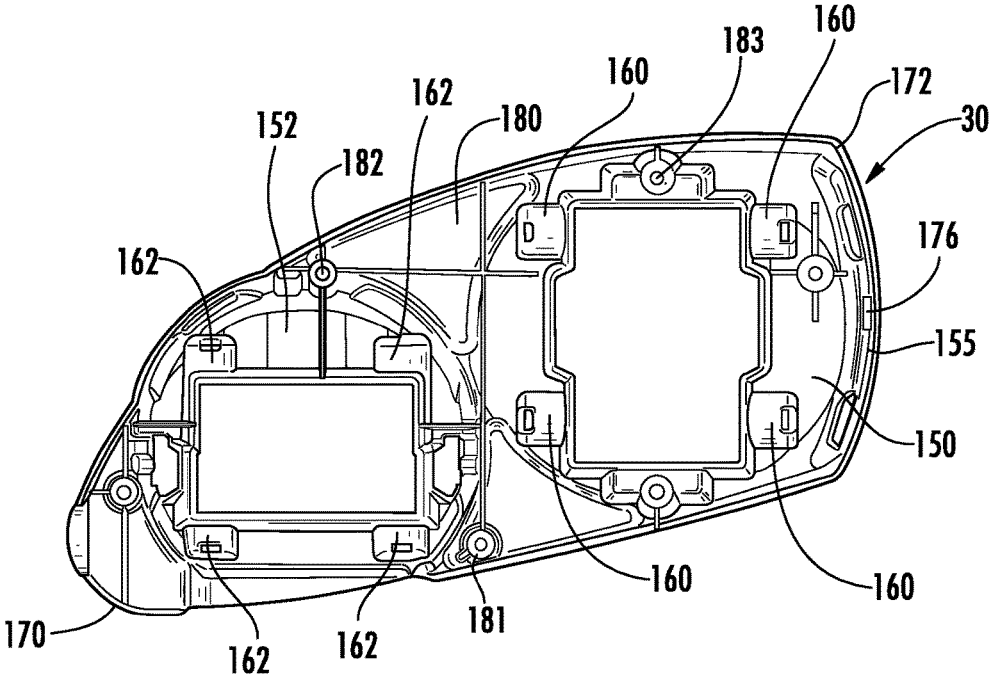
FIG. 19 is a back view of the reflector carrier without high and low beam headlamp modules installed.
Figure 20:
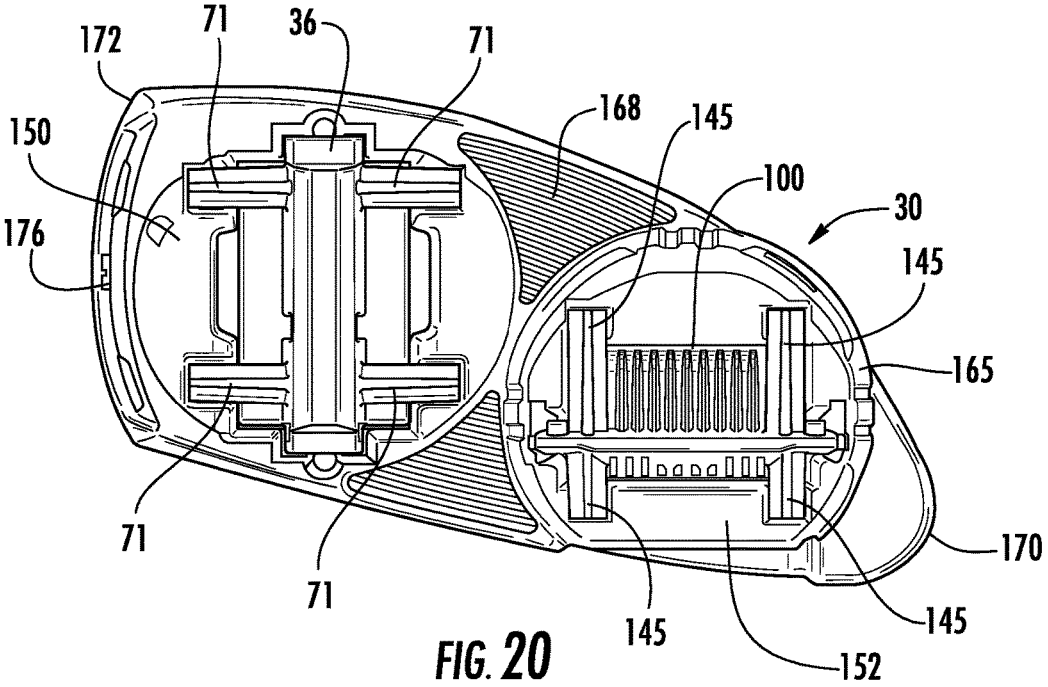
FIG. 20 is a front view of the reflector carrier with heat sink and mounting assemblies in an installed position.

FIG. 19 is a back view of reflector carrier 30 without high and low beam modules 15 and 20 installed. FIG. 20 is a front view of reflector carrier with heat sink and mounting assemblies 36 and 100 in an installed position. The respective reflectors are not shown so that the positioning of the heat sink and mounting assemblies 36 and 100 may be clearly shown. As shown in FIG. 19, a back side 180 of reflector carrier includes a lower attachment point 181 and upper attachment points, generally indicated at 182, formed therein for facilitating attachment of reflector carrier 30 to housing 35.

Figure 21:
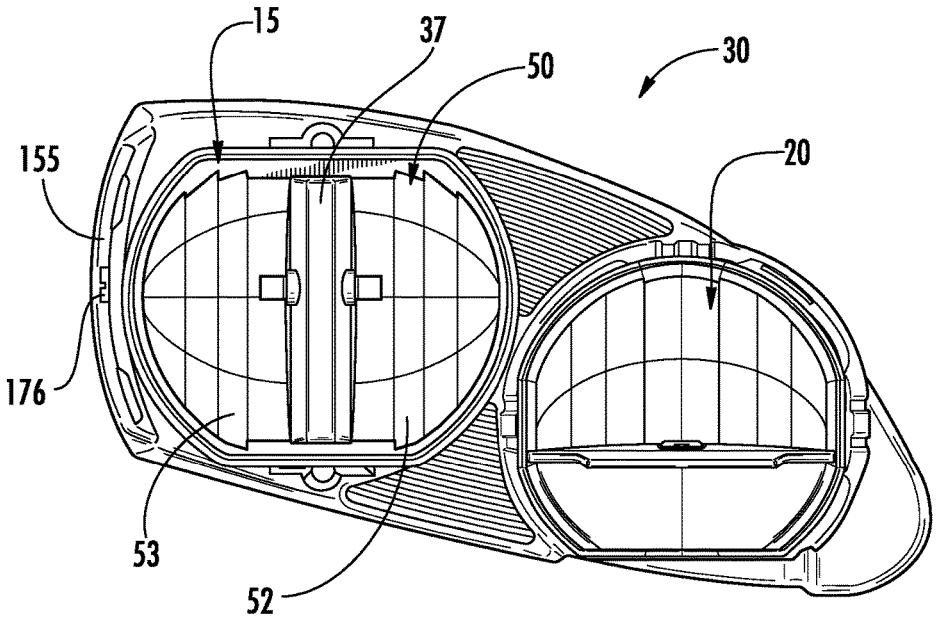
FIG. 21 illustrates a front view of the reflector carrier with high and low beam modules in an installed position.
Figure 22:
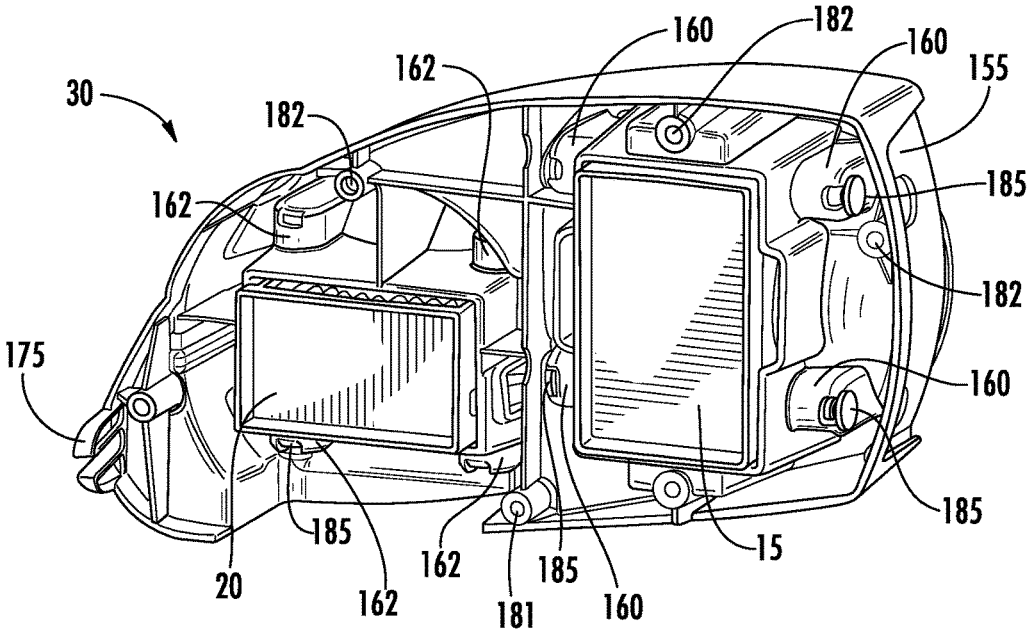
FIG. 22 is a back perspective view of the reflector carrier.
Figure 23:
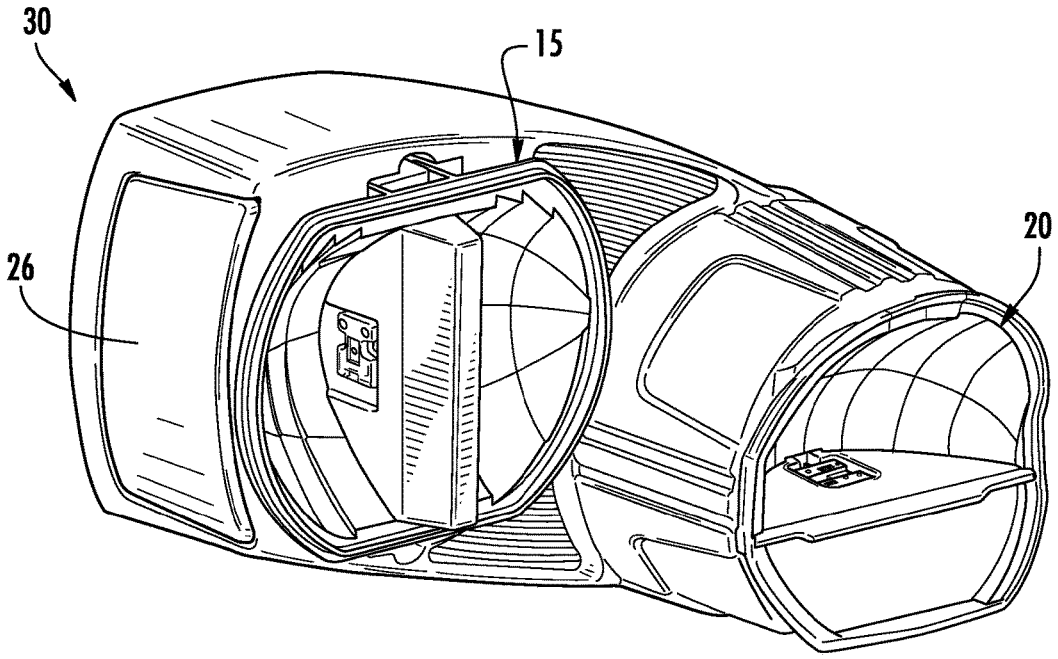
FIG. 23 illustrates a front perspective view of the reflector carrier with high and low beam modules in an installed position.

FIGS. 21-23 illustrate reflector carrier 30 with high and low beam modules 15 and 20 in an installed position. FIGS. 21 and 23 are front and front perspective views, respectively. FIG. 22 is a back perspective view of reflector carrier 30. As shown, fasteners 185 are used to secure mounting extensions 71 of low beam module 15 within recesses 160 such that low beam module 15 is securely attached to reflector carrier 30. Similarly, second receiving pocket 152 includes recesses 162 formed therein for accepting mounting extensions 145 of high beam module 20 such that high beam module 20 is properly aligned within reflector carrier.

Figure 24:
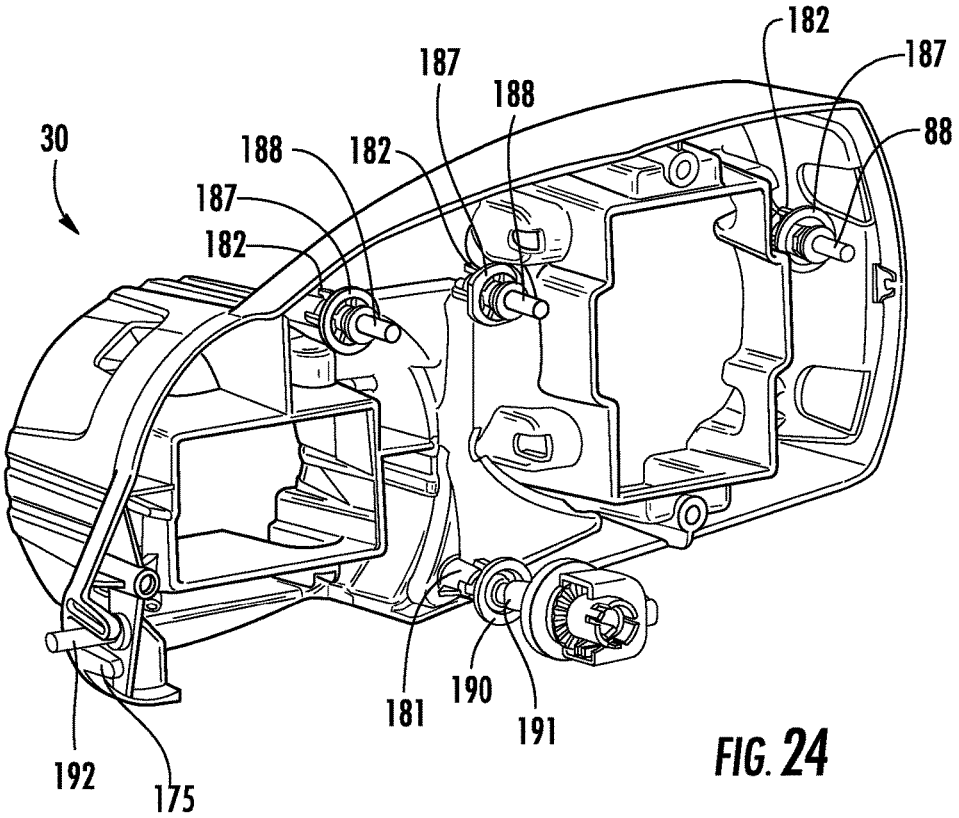
FIG. 24 is a back perspective view of the reflector carrier with several attachment features for facilitating the attachment of reflector carrier to a housing.

As shown in FIG. 24, reflector carrier 30 includes several attachment features for facilitating the attachment of reflector carrier 30 to housing 35. For example, sockets, which are generally indicated at 187, and pivot studs 188 are adapted to be fastened to upper attachment points 182. In addition, a lower socket 190 and a reflector carrier adjuster pivot stud 191 are adapted to be attached to lower attachment point 181. A stabilizer screw 192 is also shown engaging carrier stabilizer feature 175. Reflector carrier 30 is able to rotate on stabilizer screw 192 to allow for vertical adjustment of the beam pattern. In addition, stabilizer screw 192 helps to minimize vibration of reflector carrier 30 at the un-supported end, i.e. upper corner 172. Thus, stabilizer screw 172 threaded into housing 35 and rigidly attached such that stabilizer screw 172 acts as a support member for reflector carrier 30.

Figure 26:
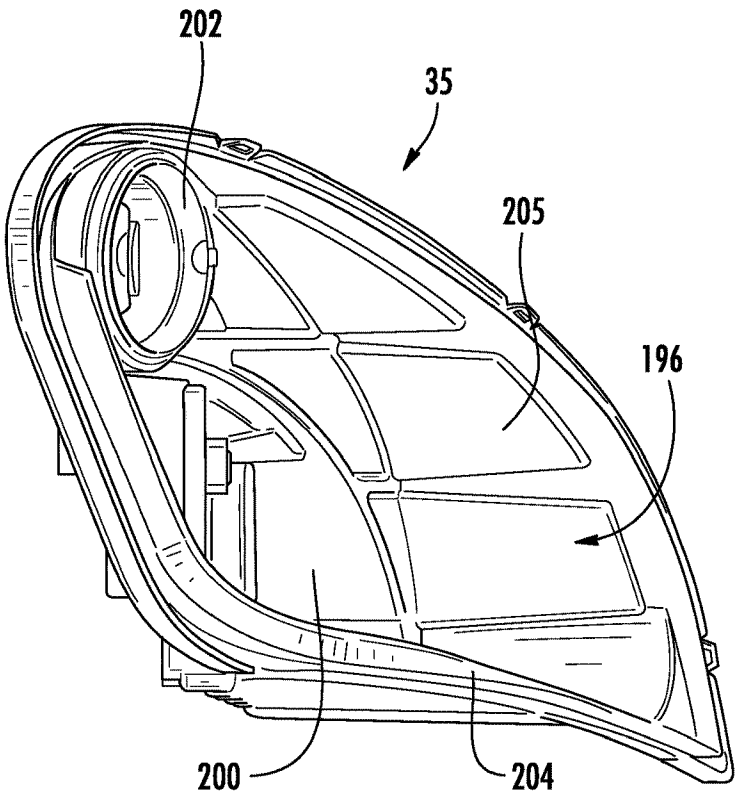
FIGS. 25-27 are front views of a housing of the modular headlamp assembly.
Figure 25:
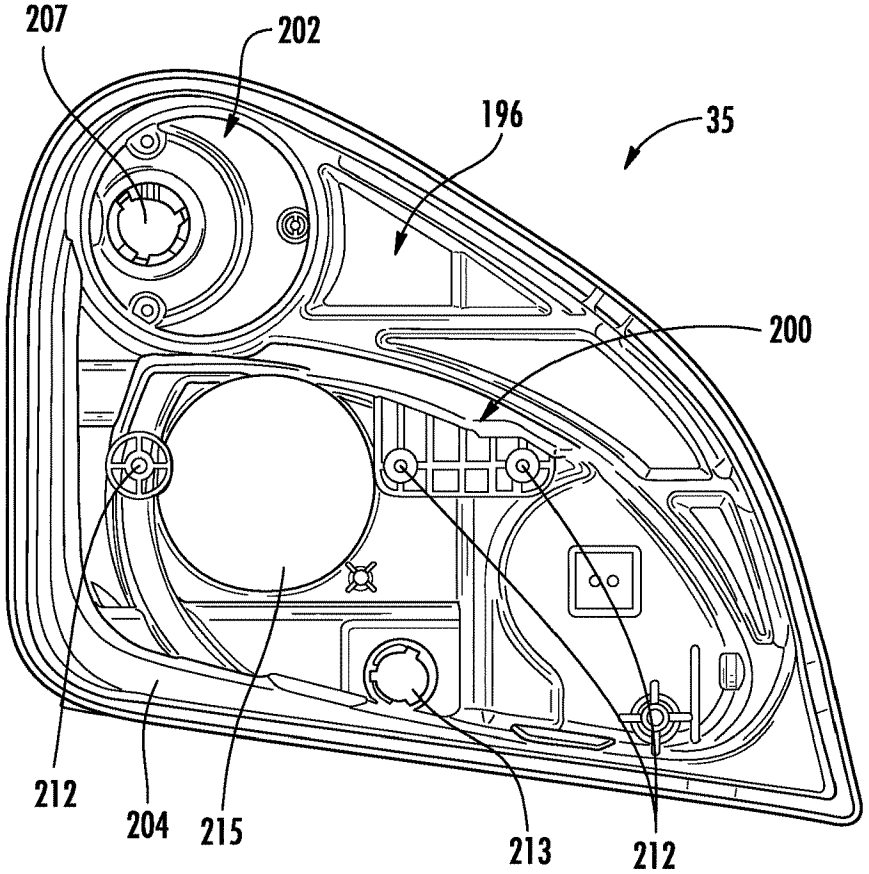
Figure 27:
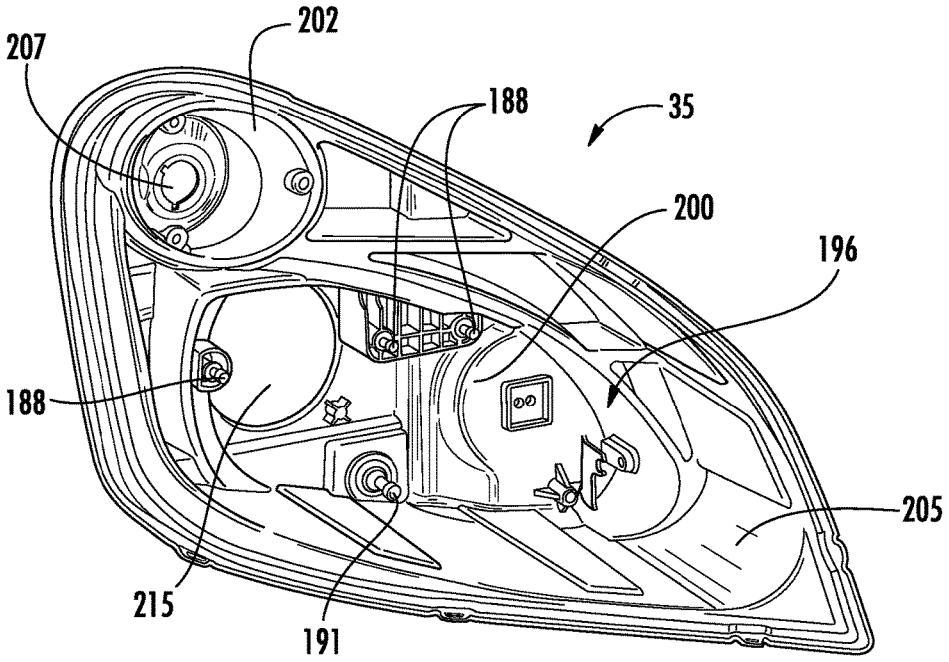

Housing 35 will now be described with reference to FIGS. 25-36. FIGS. 25-27 are front views of housing 35. In general, housing 35 includes an interior 196 and an exterior portion 197. Interior portion 196 has a reflector carrier mounting area 200 and a front turn/parking lamp reflector mounting area 202 formed therein. Housing also includes a rim 204 defining the shape of housing 35. Housing 35 also includes a raised wall 205 that accommodates the depth of side wall 165 of second receiving pocket 152 of high beam module 20. Front turn/parking lamp reflector mounting area 202 includes a cam feature 207 and attachment features, such as openings 209, formed therein. In addition, reflector carrier mounting area 200 includes attachment points 212, a cam opening 213 and a circuit board module receiving opening 215 formed therein. FIG. 27 illustrates reflector carrier pivot studs 188 fastened to attachment points 212 to facilitate attachment of reflector carrier 30 to housing 35. In addition, reflector carrier adjuster pivot stud 191 is shown attached to cam opening 213.

Figure 28:
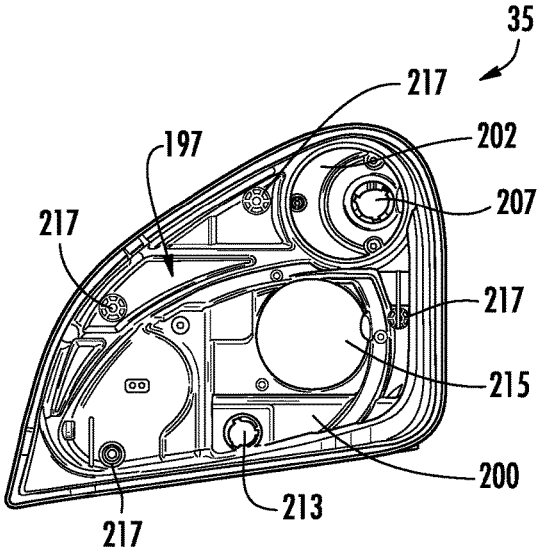
FIG. 28 is a back view of the housing of the modular headlamp assembly.
Figure 29:
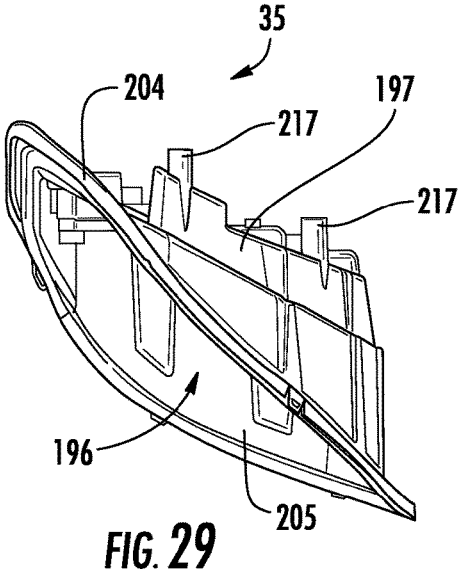
FIG. 29 is a top view of the housing of the modular headlamp assembly.
Figure 30:
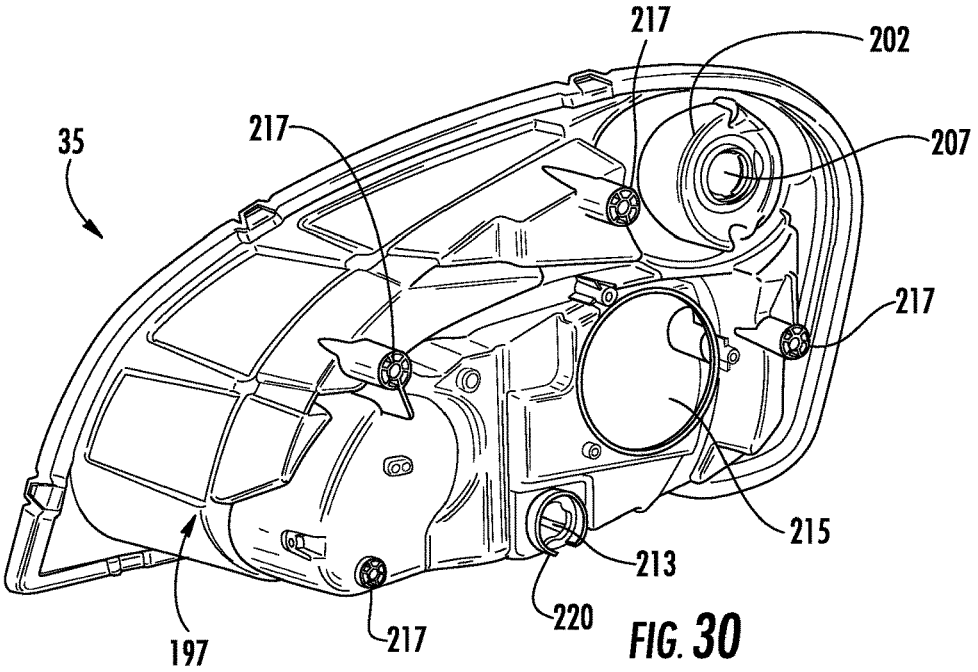
FIG. 30 is a back perspective view of the housing.

FIGS. 28-30 illustrate back, top and back perspective views of housing 35. Exterior portion 197 of housing 35 includes attachment points or features 217 for mating with mounting studs on a vehicle (not shown). A rim 220 is formed around cam opening 213 such that a gear box assembly 225 (See FIG. 31) can be easily attached to adjuster pivot stud 191 in order to manipulate reflector carrier 30.

Figure 31:
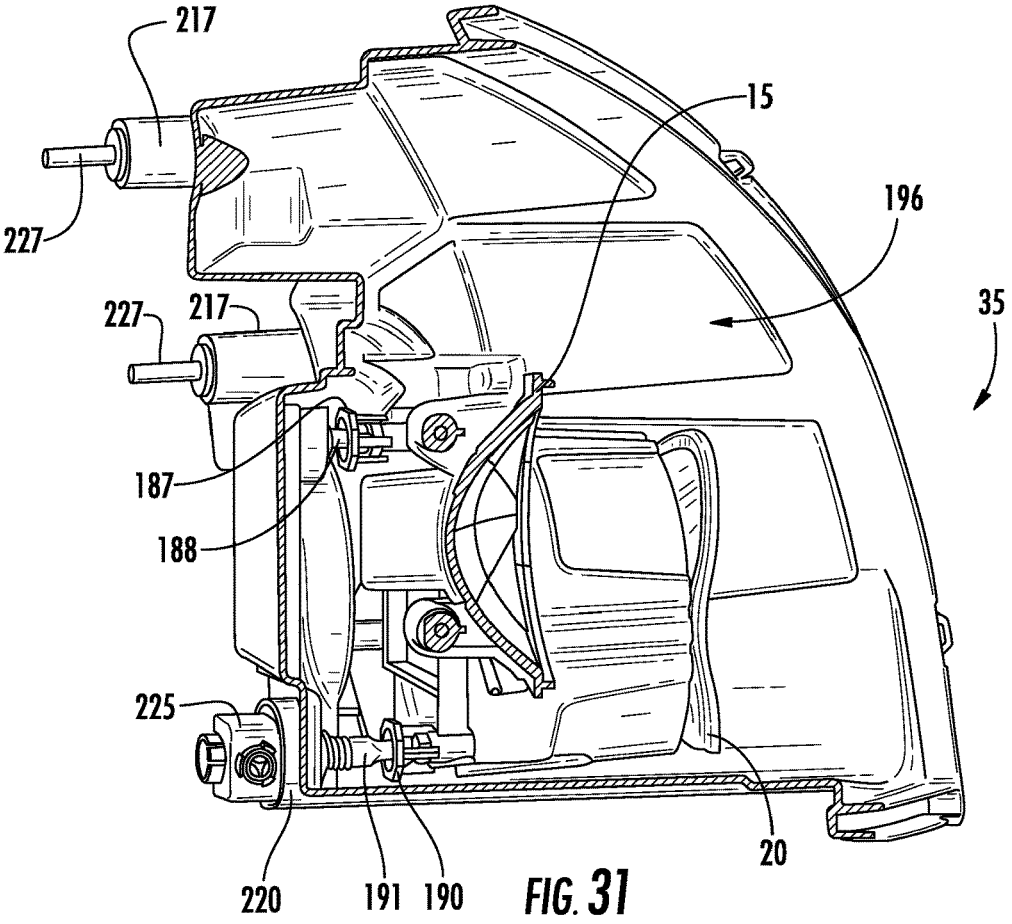
FIG. 31 is a cross-sectional view of the housing with the reflector carrier attached.

A cross-sectional view of housing 35 with reflector carrier 30 installed is shown in FIG. 31. Sockets 187 and 190, which are attached to reflector carrier 30, are snapped onto reflector carrier pivot studs 188 and reflector carrier adjuster pivot stud 191, respectively. Adjuster pivot stud 191 is accessible from behind modular headlamp assembly 10 by way of gear box assembly 225. In the embodiment shown, turning gear box assembly 225 clockwise lengthens or shortens the adjuster pivot stud, thereby adjusting the vertical aim of reflector carrier 30. The adjustment of reflector carrier 30 results in the simultaneous adjustment of low and high beam modules 15 and 20 by way of lengthening or shortening adjuster pivot stud 191. In addition, attachment features 217 are shown coupled to vehicle mounting studs 227 to facilitate attachment of modular headlamp assembly 10 to a vehicle.

Figure 32:
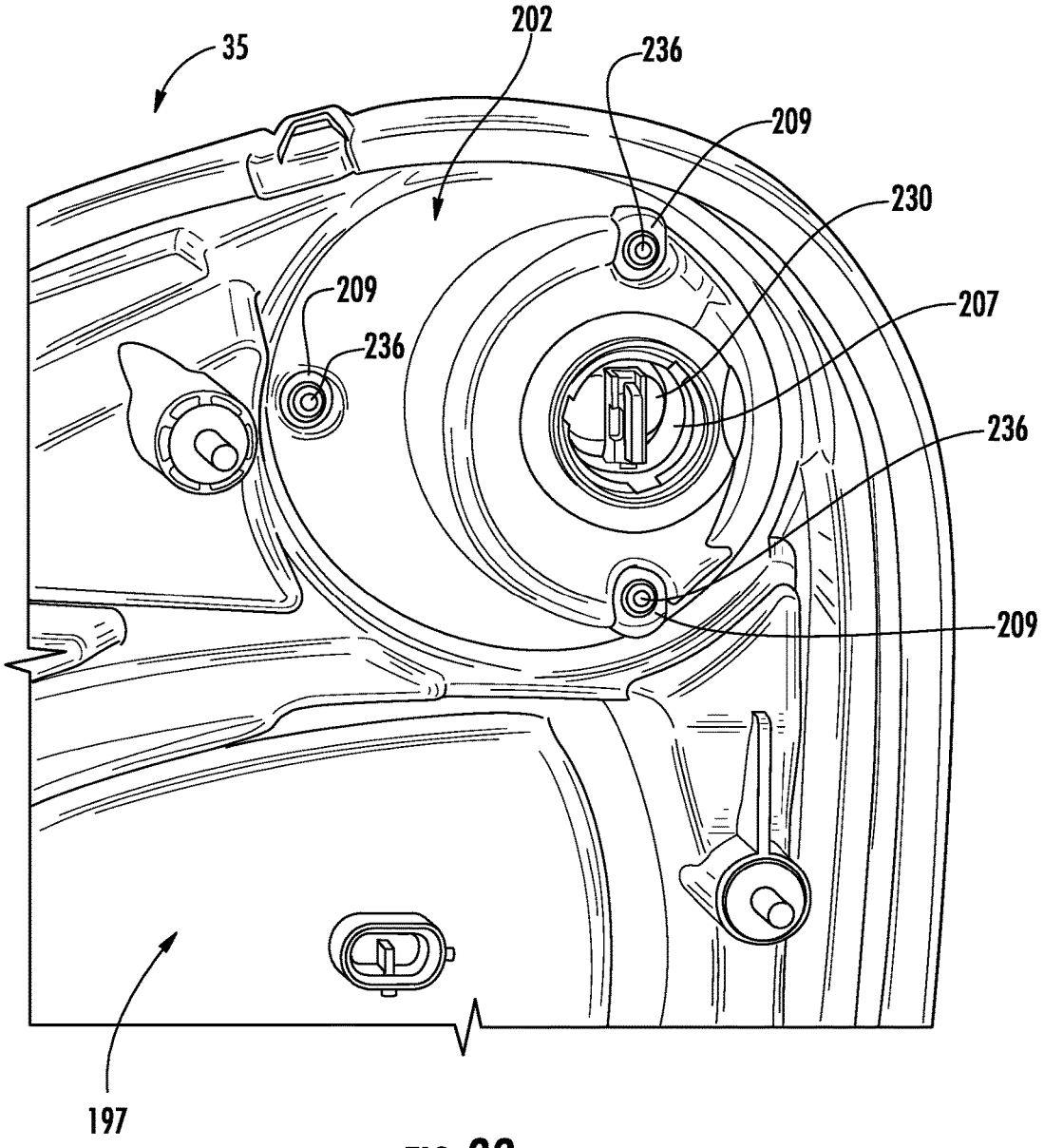
FIG. 32 is an enlarged rear view of a front turn/parking lamp receiving area of the housing.
Figure 33:
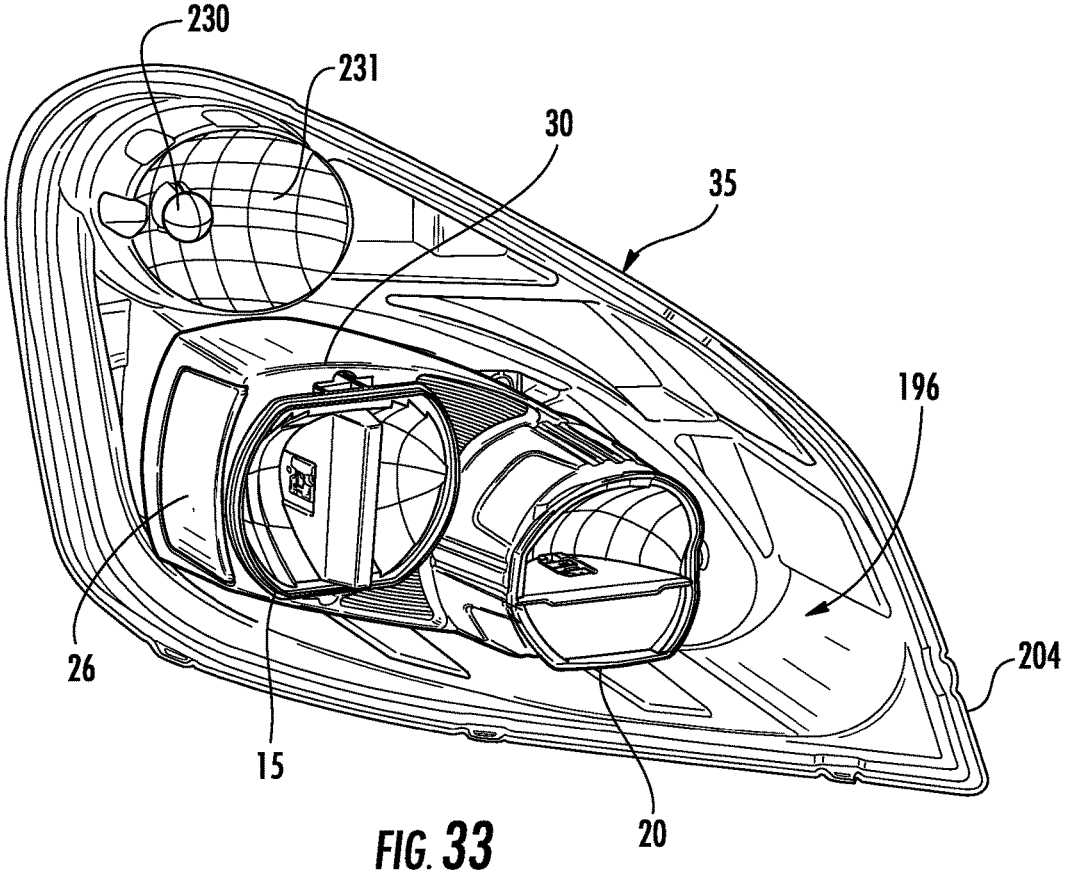
FIG. 33 is a front perspective view of the housing with the reflector carrier and the front turn/parking lamp module installed.

FIG. 32 is an enlarged rear view front turn/parking lamp receiving area 202 of housing 35 and FIG. 33 is a front perspective view of housing 35 with reflector carrier 30 and turn/parking lamp module 22 installed. Front turn/parking lamp receiving area 202 includes attachment openings 209 for receiving fasteners 236 for securing a reflector 231 of the front turn/parking lamp module 22 to housing 35. In alternate embodiments, front turn/parking lamp module 22 may include an LED light source rather than an incandescent bulb 24. In the embodiment illustrated, front turn/parking lamp bulb 24 is secured to housing 30 through cam feature 207. A lens (not shown) is positioned over modular headlamp assembly for connection to housing 35 at rim 204.

Figure 34:
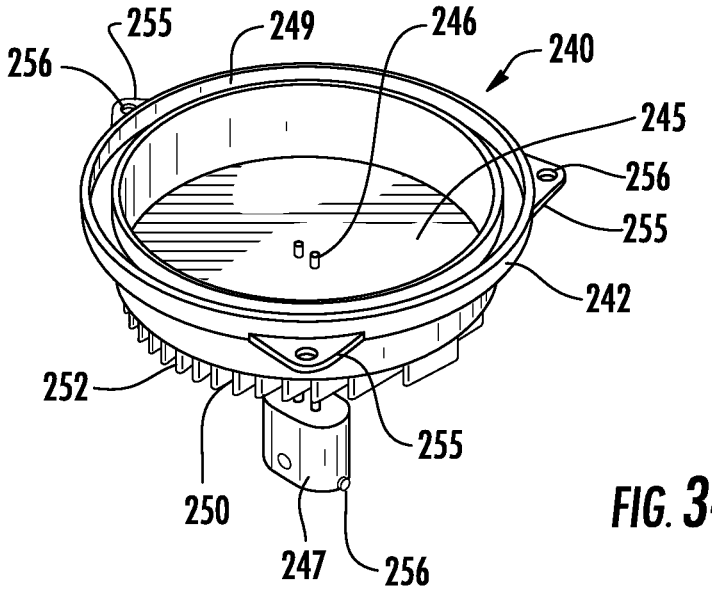
FIG. 34 illustrates a side perspective view of a drive circuit module of the modular headlamp assembly.
Figure 35:
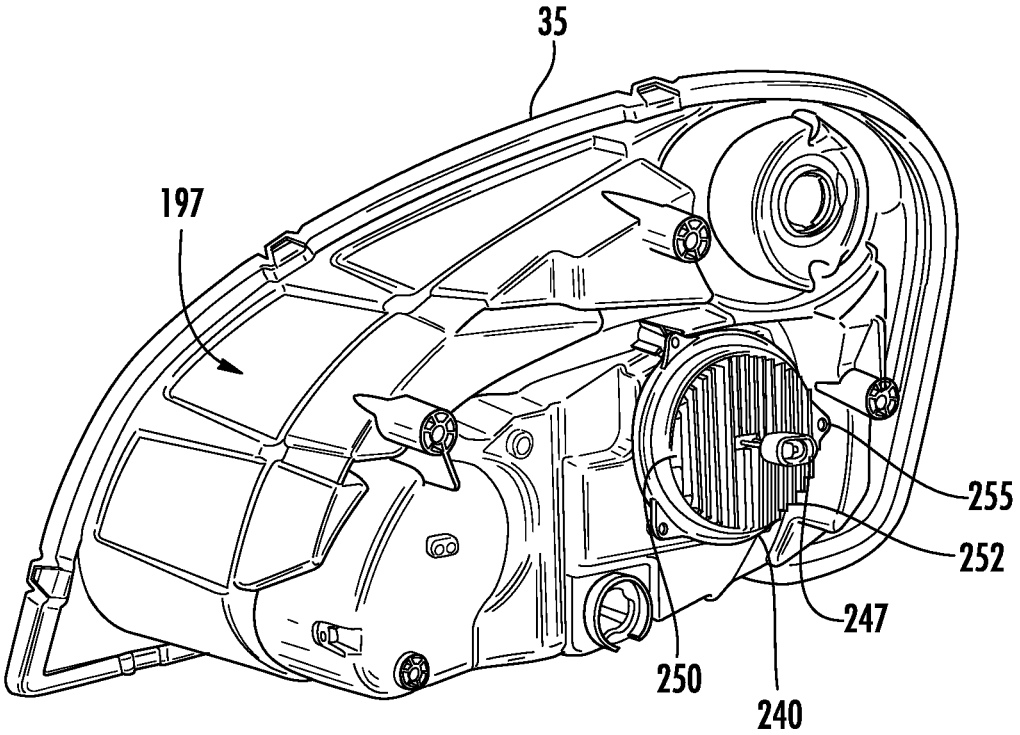
FIG. 35 is a back perspective view of the housing with the drive circuit module attached.

With reference to FIGS. 34 and 35, modular headlamp assembly may also include a drive circuit module 240 including a drive circuit housing 242 with an interior portion 245 adapted to contain a circuit board, such as a FR4 circuit board. Electrical leads 246 and connector 247 are adapted to connect the circuit board to a power source. Interior portion 245 is surrounded by a rim track 249 having a gasket positioned therein (not shown). Drive circuit housing 242 is formed of a thermally conductive material and acts as a heat sink. In addition, drive circuit housing 242 includes a back portion 250 having fins 252 formed therein for heat dissipation. Attachment tabs 255 with apertures 256 extend from drive circuit housing 242 for attaching drive circuit module 240 to headlamp housing 35. Drive circuit module 240 is mounted to headlamp housing 35 at circuit board module receiving opening 215, which is shown in FIG. 25 without drive circuit module attached.

Figure 36:
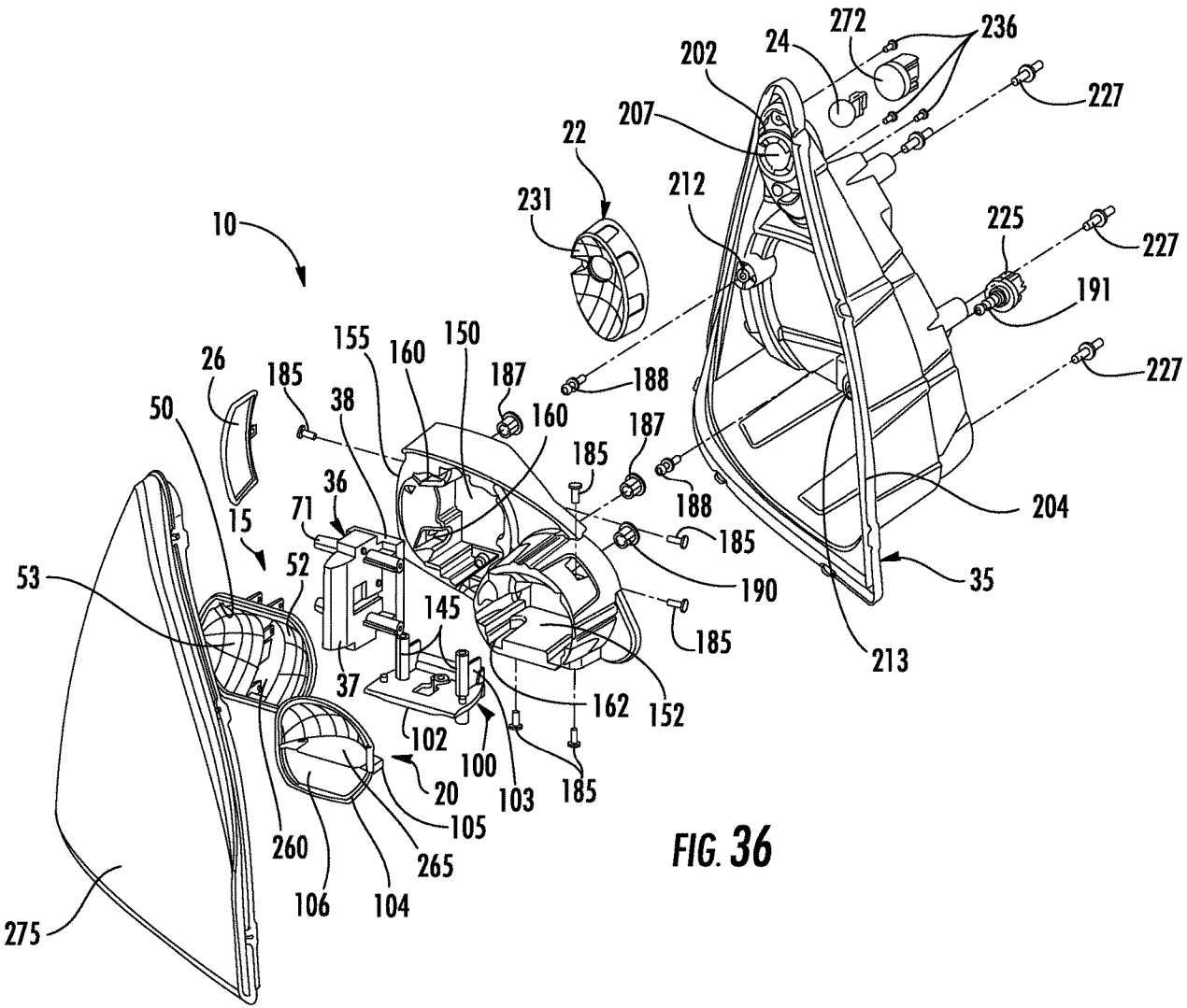
FIG. 36 is an exploded view of the modular headlamp assembly.

FIG. 36 is an exploded view of modular headlamp assembly 10 for illustrating the manner in which low beam headlamp module 15, high beam headlamp module 20, reflector carrier 30 and housing 35 are assembled. As discussed above, low beam headlamp module 20 includes low beam reflector member 50 and heat sink and mounting assembly 36 with low beam heat sink portion 37 and low beam mounting portion 38.

Low beam heat sink portion 37 extends through a gap 260 formed between first and second reflector segments 52 and 53, such that low beam heat sink portion 37 bisects reflector member 50. Similarly, high beam headlamp module 20 includes a high beam heat sink and mounting assembly 100 having a high beam heat sink portion 102 and a high beam mounting portion 103. High beam reflector member 104 includes an upper reflective portion 105 and a lower portion 106 with a gap 265 formed therebetween. In an assembled position, high beam heat sink portion 102 extends through gap 256, such that upper reflective portion 105 and a lower portion 106 are separated by high beam heat sink portion 102.

Low beam headlamp module 15 fits within first receiving pocket 150 of reflector carrier 30 and high beam headlamp module 20 fits within second receiving pocket 152 of reflector carrier 30. Mounting extensions 71 of low beam module 15 are received within recesses 160 formed within first receiving pocket 150. Similarly, mounting extensions 145 of high beam module 20 are received within recesses 162 formed within second receiving pocket 152 such that high beam module 20 is properly aligned within reflector carrier 30. Fasteners, such as screws 185, are used to secure low beam headlamp module 15 and high beam headlamp module 20 to reflector carrier 30. Side reflex reflector 26 is also attached to reflector carrier 30 at receiving slot 155.

Reflector carrier 30 is attached to housing 35 by way of sockets 187 and 190, along with pivot studs 188 and reflector carrier adjuster pivot stud 191. Pivot studs 188 are coupled to attachment points 212 to facilitate attachment of reflector carrier 30 to housing 35. In addition, reflector carrier adjuster pivot stud 191 attaches to socket 190 through cam opening 213. Adjuster pivot stud 191 is accessible from behind modular headlamp assembly 10 by way of gear box assembly 225. In the embodiment shown, turning gear box assembly 225 clockwise lengthens or shortens the adjuster pivot stud, thereby adjusting the vertical aim of reflector carrier 30. Adjustment of the vertical aim allows for visual aiming of the modular headlamp assembly 10. The beam pattern is projected onto a flat screen or wall and the vertical aim of the pattern is adjusted until the horizontal cut-off in the beam pattern is aligned with the horizontal reference line on the screen. Adjuster pivot stud 191 is turned until the horizontal cut-off in the pattern is deemed to align with the horizontal reference line on a screen. Vehicle mounting studs 227 to facilitate attachment of modular headlamp assembly 10 to a vehicle.

Turn/parking lamp module 22 installed within front turn/parking lamp receiving area 202 of housing 35. In particular, front turn/parking lamp bulb 24 is secured to housing 30 through cam feature 207 and reflector 231 is secured to housing 35 with fasteners 236. Front turn/parking lamp bulb 24 is secured to housing 30 through cam feature 207. A socket assembly 272 is also included to secure front turn/parking lamp module 22 to housing 35. A lens 275 is positioned over modular headlamp assembly 10 for connection to housing 35 at rim 204.

While description has been made in connection with embodiments and examples of the present invention, those skilled in the art will understand that various changes and modification may be made therein without departing from the present invention. It is aimed, therefore to cover in the appended claims all such changes and modifications falling within the true spirit and scope of the present invention.

We claim:

1. A modular headlamp assembly comprising a low beam headlamp module, a high beam headlamp module, and a reflector carrier having a first receiving pocket for containing the low beam headlamp module and a second receiving pocket for containing the high beam headlamp module, said low beam headlamp module including:

a low beam heat sink and mounting assembly including a low beam heat sink portion having first and second sides and a low beam mounting portion, said low beam mounting portion having alignment features formed therein;

at least one first low beam LED light source supported by the first side of the heat sink portion and at least one second low beam LED light source supported by the second side of the heat sink portion; and a low beam reflector member including a first reflective portion and a second reflective portion, said low beam heat sink portion separating the low beam reflector member into the first reflective portion and the second reflective portion, wherein light emitted by said at least one first low beam LED light source is reflected by the first reflector segment and light emitted by said at least one second low beam LED light source is reflected by the second reflector segment, said low beam reflector member including mating features for engaging the alignment features formed on the low beam mounting portion to facilitate the alignment of the low beam reflector member with the low beam heat sink and mounting assembly; and wherein the low beam headlamp module is positioned adjacent to the high beam headlamp module in the reflector carrier.

2. The modular headlamp assembly of claim 1, wherein the low beam heat sink and mounting assembly is treated with a black thermally emissive coating to facilitate heat transfer through radiation.

3. The modular headlamp assembly of claim 2, further comprising:

a housing containing the reflector carrier; and wherein the reflector carrier includes a plurality of attachment features formed within a back side of the reflector carrier and at least one of said plurality of attachment features facilitates adjustable attachment of the reflector carrier to the housing.

4. The modular headlamp assembly of claim 3, wherein the low beam headlamp module includes a heat sink oriented in a first plane and the high beam heat sink is oriented in a second plane that is perpendicular to the first plane.

5. The modular headlamp assembly of claim 4, wherein the low beam heat sink and mounting assembly is a unitary member.

6. The modular headlamp assembly of claim 5, wherein the first side of the low beam heat sink portion includes a first indented light source receiving portion formed therein and the second side of the low beam heat sink portion includes a second indented light source receiving portion formed therein.

7. The modular headlamp assembly of claim 2, wherein said low beam heat sink comprises an outwardly extending portion wherein said outwardly extending portion protrudes beyond a rim of said reflector.

8. The modular headlamp assembly of claim 1, wherein the first receiving pocket for containing the low beam headlamp module is positioned adjacent to the second receiving pocket for containing the high beam headlamp module in the reflector carrier.

* * * * *